US008480038B1

(12) United States Patent
Anderson et al.

(10) Patent No.: US 8,480,038 B1
(45) Date of Patent: Jul. 9, 2013

(54) RAILROAD CROSSING GATE HEIGHT ADJUSTMENT ASSEMBLY AND METHOD

(71) Applicant: Signal Innovations, Inc., Orange Park, FL (US)

(72) Inventors: Jonathan S. Anderson, Bradenton, FL (US); William M. McInnes, Ruskin, FL (US)

(73) Assignee: Signal Innovations, Inc., Orange Park, FL (US)

( * ) Notice: Subject to any disclaimer, the term of this patent is extended or adjusted under 35 U.S.C. 154(b) by 0 days.

(21) Appl. No.: 13/647,491

(22) Filed: Oct. 9, 2012

Related U.S. Application Data

(63) Continuation-in-part of application No. 13/162,897, filed on Jun. 17, 2011, now Pat. No. 8,297,557.

(51) Int. Cl.
*B61L 23/00* (2006.01)

(52) U.S. Cl.
USPC ..... 246/111; 246/118

(58) Field of Classification Search
USPC ..... 246/111–125
See application file for complete search history.

(56) References Cited

U.S. PATENT DOCUMENTS

| | | | | | |
|---|---|---|---|---|---|
| 2,633,169 | A * | 3/1953 | Siems | 81/457 |
| 3,394,498 | A * | 7/1968 | Reinitz et al. | 49/141 |
| 4,090,685 | A * | 5/1978 | Pappas | 246/125 |
| 6,142,426 | A * | 11/2000 | Zaro et al. | 246/125 |
| 6,523,788 | B2 * | 2/2003 | Zander | 246/111 |
| 6,776,377 | B1 * | 8/2004 | Watkins | 246/111 |
| 7,699,271 | B2 * | 4/2010 | Ward | 246/111 |
| 7,789,348 | B2 * | 9/2010 | Ruggiero et al. | 246/111 |
| 2005/0060936 | A1 * | 3/2005 | Burke | 49/49 |
| 2009/0116903 | A1 * | 5/2009 | Causey et al. | 404/6 |

* cited by examiner

*Primary Examiner* — Jason C Smith
(74) *Attorney, Agent, or Firm* — Charles J. Prescott, P.A.

(57) ABSTRACT

A railroad crossing gate height adjustment assembly and method for establishing or reestablishing a height of the crossing gate of a railroad crossing gate apparatus. The assembly includes an elongated smooth pipe having a smooth exterior surface and a sliding coupling slidably engageable at a lower end along a length of the smooth pipe. A larger, upper end of the sliding coupling is threadably engageable with a coupling previously secured at a lower end of a wiring conduit of the gate apparatus whereby the length of the wiring conduit is adjustably increased by an exposed length of the smooth pipe. A lower end of the smooth pipe has an external thread which is threadably engageable into a threaded hole formed into a top surface of a gate base of the gate apparatus for supportively receiving a lower end of the smooth pipe.

3 Claims, 11 Drawing Sheets

RAILROAD CROSSING GATE HEIGHT ADJUSTMENT ASSEMBLY AND METHOD

CROSS-REFERENCE TO RELATED APPLICATIONS

This application is a continuation-in-part of application Ser. No. 13/162,897, filed Jun. 17, 2011.

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to railroad gate crossing apparatus, and more particularly to a railroad crossing gate height adjustment assembly and method for repositioning the height of the crossing gate above a new road approach surface to the railroad tracks.

2. Description of Related Art

Federal and/or regional code establishes the range of height of a road or highway crossing gate of a railroad crossing and signaling apparatus. However, the road approaches on either side of the railroad tracks crossing the road are subject to substantial wear and abuse as vehicles pass over the railroad tracks. These road approaches thus deteriorate much faster than the adjacent road surface in general and require more frequent road approach repair and/or replacement so as to minimize impact to the cars and trucks passing thereover as the road approach wear becomes excessive.

In effecting such road approach repair, when the road is resurfaced by the state, county, or if the railroad needs to replace ties in the road crossing or change out the crossing panels, a crew is dispatched to raise the railroad tracks to a height that will be compatible with the new higher road surface. All railroads have tie change out programs each year. Most of the road crossings during this tie change out program are usually redone resulting in the road and track being raised thus affecting the height of the crossing gate, although the railroad tracks themselves can remain fixed and unaltered in height or be raised. The road approach immediately adjacent to the tracks is typically coated over with an additional layer of road surface material such as asphalt or concrete. Because the crossing gate, when closed, is positioned at a short distance from the railroad tracks, the additional road repair layer added to the road approach diminishes the effective height of the crossing gate above the new road approach surface.

When such repairs occur, and the minimum required height of the crossing gate is thus effectively diminished, a separate maintenance procedure reestablishes and raises the height of the crossing gate when down in the "train approaching" position. Because there is a wiring conduit which extends between the gate base fixed into the ground and the gate mechanism positioned at the upper end of the wiring conduit, the typical maintenance procedure requires that this wiring conduit be removed, after which the gate mechanism and connected crossing gate are lifted upwardly on the signal mast of the crossing gate apparatus. The bundle of internal wiring within the wiring conduit is then disconnected at one end or cut so that the original wiring conduit may be removed and a longer one of exact new length installed with the internal wiring bundle being reinstalled or replaced and reconnected within the new longer wiring conduit. Thereafter, the gate mechanism is then lowered slightly so that the lower coupling at the end of the new wiring conduit may be reconnected to the top surface of the gate base. This procedure must be followed each time the road approach is resurfaced.

Applicant routinely engages in this activity as an employee of a national railroad company. He advises that a typical height reestablishment of the crossing gate will take a crew of three employees approximately a day if a signal crew of four men and a foreman with a backhoe and a boom truck to dig the gate foundation up and raise it with the boom truck is not available. When disconnecting the crossing gate wires, protection over the crossing must be provided with a 100 J stop and flag railroad crossing for all trains which means the train must stop short of the railroad crossing. A member of the train crew stops traffic, puts two fuses in the road and instructs the train to cross the road, gets back on the train and proceeds on. Each train must do this until the gate wires are connected back up and the crossing gate is tested. With the four man signal crew, it may take ½ day or more depending on if there are no utilities (like gas, fiber, water or electric). If there are and the backhoe can't be used, it must be dug by shovel. This way is used most because the 100 J stop and flag crossing only needs to be used when the boom truck lifts the crossing signal to the right height and the lights have been refocused and the crossing retested.

When the present invention is used on new crossing gate installations and installed while building and wiring the crossing gate, one man will be able to raise the gate height in about ½ hour. New gate mechanisms have more than enough slack on the wires so that the gate could be raised for many years. Slack on the wires is pushed back into the gate base. All the slack on the wires may also be clamped inside the gate mechanism so that, before the gate is raised, the clamp can be loosened and the wire will not get tangled up while the gate is being raised.

The present invention provides for an assembly which facilitates present and subsequent height readjustment of the crossing gate without the necessity of replacing the original wiring conduit and without the necessity of rewiring of the crossing gate apparatus.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a railroad crossing gate height adjustment assembly and method for establishing or reestablishing a height of the crossing gate of a railroad crossing gate apparatus. The assembly includes an elongated smooth pipe and a sliding coupling slidably engageable at a lower end thereof along a length of the smooth pipe. A larger, upper end of the sliding coupling is threadably engageable with a coupling previously secured at a lower end of a wiring conduit of the gate apparatus whereby the length of the wiring conduit is adjustably increased by an exposed length of the smooth pipe. A lower threaded end of the smooth pipe has an external thread which is threadably engageable into a threaded hole formed into a top surface of a gate base of the gate apparatus.

This assembly may be used on any and all types of gate mechanism signals to allow for gate arm height adjustment of the gate arm when the gate arm is in the downward position. When the gate arm is in the down position, state and/or federal regulations will apply as to the height of the gate arm from the top of the road. This invention will allow the gate arm height to be raised or lowered accurately and easily, depending upon the requirements.

In a first use embodiment, the assembly may be used on a new installation or an upgrade installation of a railroad crossing signal location. Precision gate arm height adjustment can be obtained on each and every gate mechanism signal arm at the railroad crossing location. In a second use embodiment, the assembly may be used when a gate mechanism signal needs to be replaced due to damage from a crossing accident or replacement due to maintenance upgrade which will allow for precision height adjustment of the crossing gate arm when the new gate mechanism signal is installed. When the assembly is used with a gate mechanism signal, the gate arm can be raised or lowered to the proper height when the highway and/or railroad tracks are raised or lowered on account of maintenance work.

It is therefore an object of this invention to substantially reduce the cost of reestablishing the height of the crossing gate of a railroad crossing signal apparatus after the road approach adjacent the railroad tracks is raised by repair resulting from vehicle traffic over the railroad tracks.

It is another object of this invention to permanently reduce subsequent cost of height reestablishment of the crossing gate of a railroad crossing gate apparatus for virtually all subsequent road approach repair.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Exemplary embodiments are illustrated in reference figures of the drawings. It is intended that the embodiments and figures disclosed herein are to be considered to be illustrative rather than limiting.

DETAILED DESCRIPTION OF THE INVENTION

Nomenclature

Figure 1:
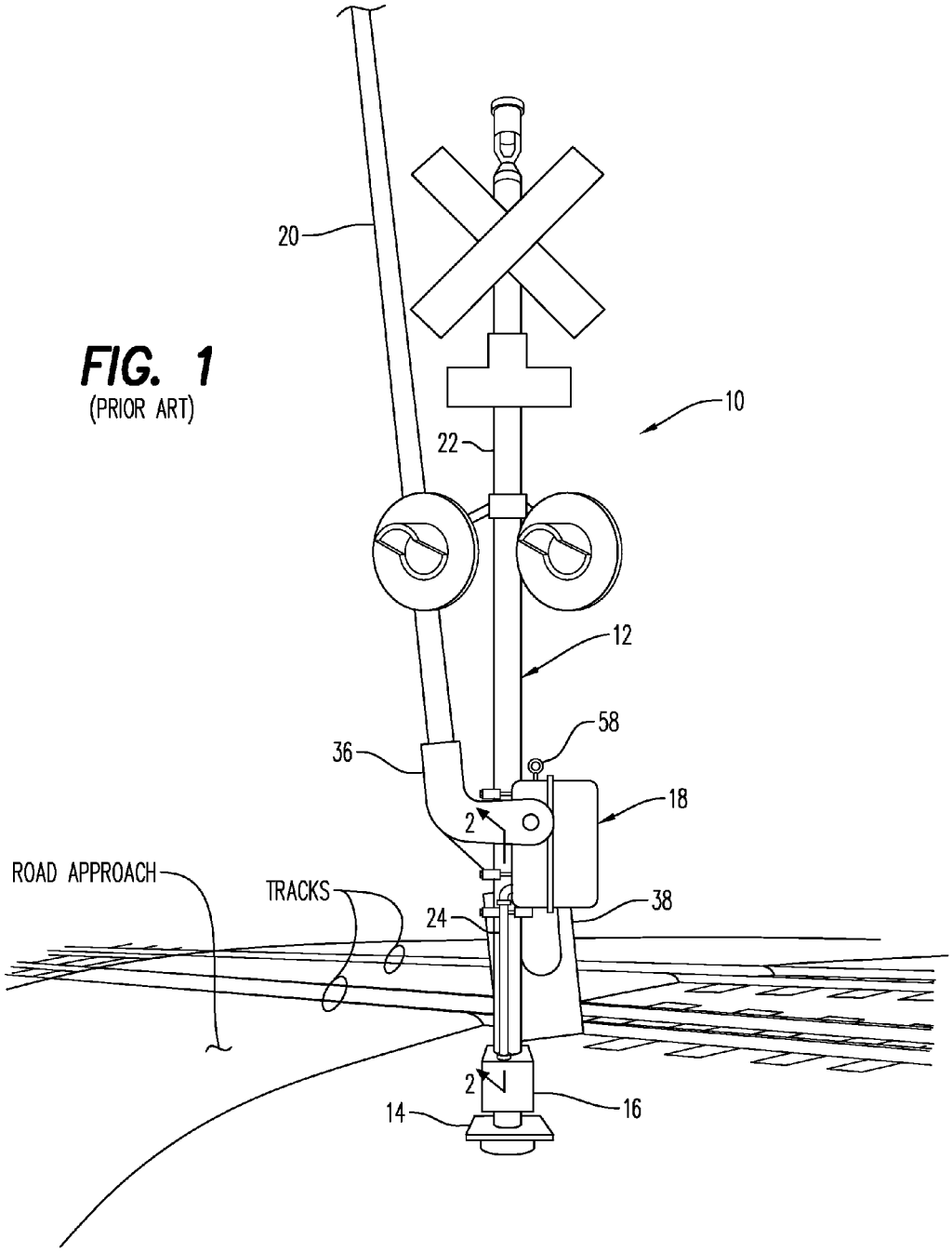
FIG. 1 (PRIOR ART)
FIG. 1 is a perspective view of a railroad crossing gate apparatus 10 positioned adjacent to the tracks of a railroad tracks crossing a roadway. (Prior Art)
Figure 2:
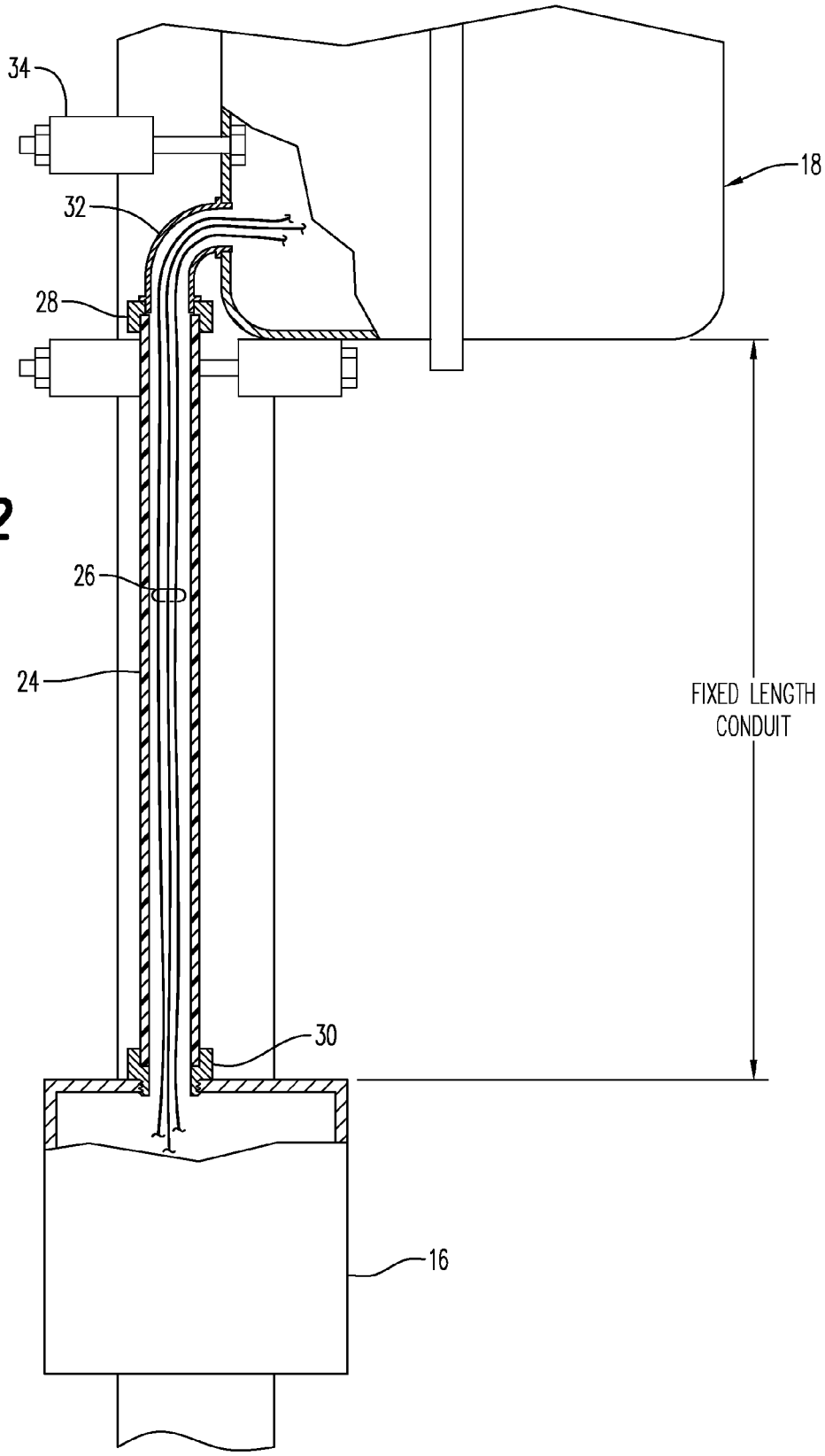
FIG. 2 (PRIOR ART)
FIG. 2 is an enlarged broken view of the lower portion of FIG. 1.

10. railroad crossing gate apparatus
12. warning signal assembly
14. signal foundation
16. gate base
18. gate mechanism
20. highway crossing gate
22. signal mast
24. flexible wiring conduit
26. internal wiring
28. upper coupling
30. lower coupling
32. conduit elbow
34. support bracket
36. gate support arm
38. gate counterweight
40. height adjustment assembly
42. threaded pipe
44. reducer
46. internal thread
48. internal thread
50. jam nut
52. bushing
54. external thread
56. internal thread
57. internal thread
58. lifting ring
59. external thread
60. height adjustment assembly
62. smooth pipe
64. sliding coupling
66. internal thread
68. sliding collar
70. mating sliding surfaces
72. pipe lower end
74. external thread Referring now to the drawings and firstly to FIGS. 1 and 2, a typical prior art railroad crossing gate apparatus is there shown generally at numeral 10 in FIG. 1 and includes a warning signal apparatus including a highway crossing gate 20 pivotally operably connected to a gate mechanism 18. In well known fashion, when a train is approaching the road on the tracks, the flashing signals warn oncoming traffic of the oncoming train while the crossing gate 20 pivots downwardly into a horizontal position above the road approach surface. All of these components are supported on a signal mast 22 which extends downwardly into a gate base 16 which in turn is supported in the ground securely by a signal foundation 14.

In FIG. 2, it is seen that the conventional arrangement for housing the wiring which extends upwardly from the gate base 16 into the gate mechanism 18 is protectively housed within an elongated wiring conduit 24. The lower end of the wiring conduit 24 is secured into a lower coupling 30 threadably engaged into an internally threaded hole in the top of the gate base 16. The upper end of the wiring conduit 24 is permanently secured or tightly secured into an upper coupling 28 which in turn is attached to a conduit elbow 32 to guide and protect the wiring bundle 26 extending therethrough.

Figure 3:
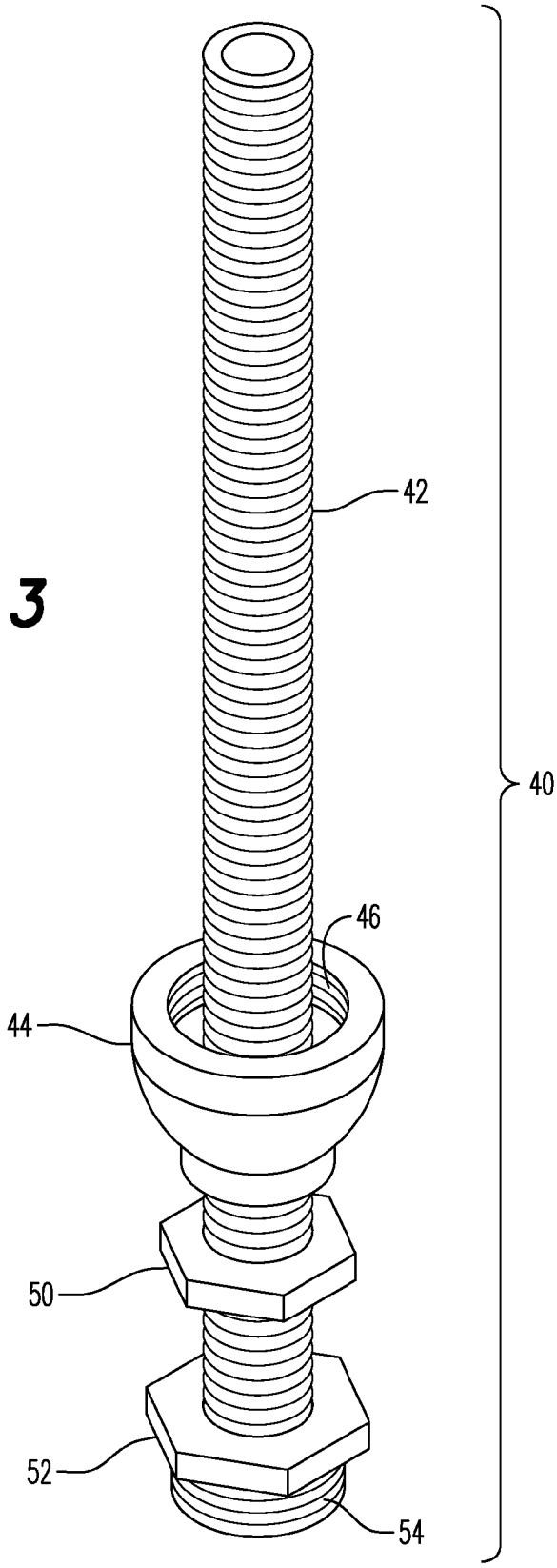
FIG. 3 is a perspective view of one embodiment of the invention.

Referring now to FIG. 3, the invention, a height adjustment assembly, is there shown generally at numeral 40 and includes an elongated threaded pipe 42 onto which a reducer 44 is threadably engaged as is a jam nut 50 and a bushing 52. The reducer 44 includes two internal threads 46 and 48 best seen in FIG. 5, the upper internal thread 46 being larger while the smaller internal thread 48 being smaller and sized to threadably engage over and along the length of the threaded pipe 42. The jam nut 50 is also threadably engaged onto the threaded pipe 42 below the reducer 44 while the bushing 52 includes an internal thread 56, again best seen in FIG. 5, and an external thread 54 which is sized to threadably and lockably engage into the threaded hole formed in the top surface of the gate base 16 after the lower coupling 30 has been removed.

Figure 4:
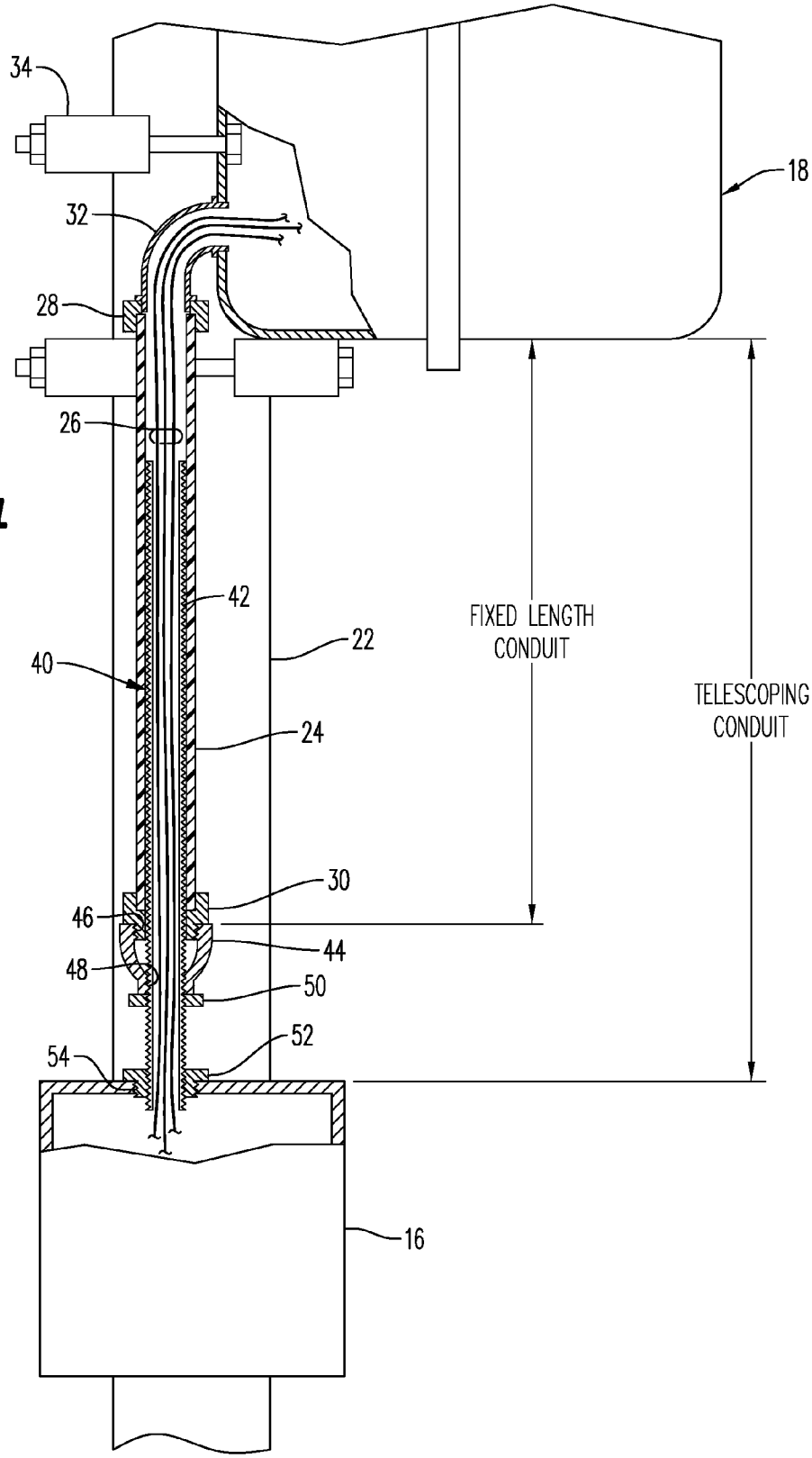
FIG. 4 is a view similar to FIG. 2 after the invention of FIG. 3 has been installed during height reestablishment of the gate mechanism 18 and crossing gate attached thereto (not shown for clarity).
Figure 5:
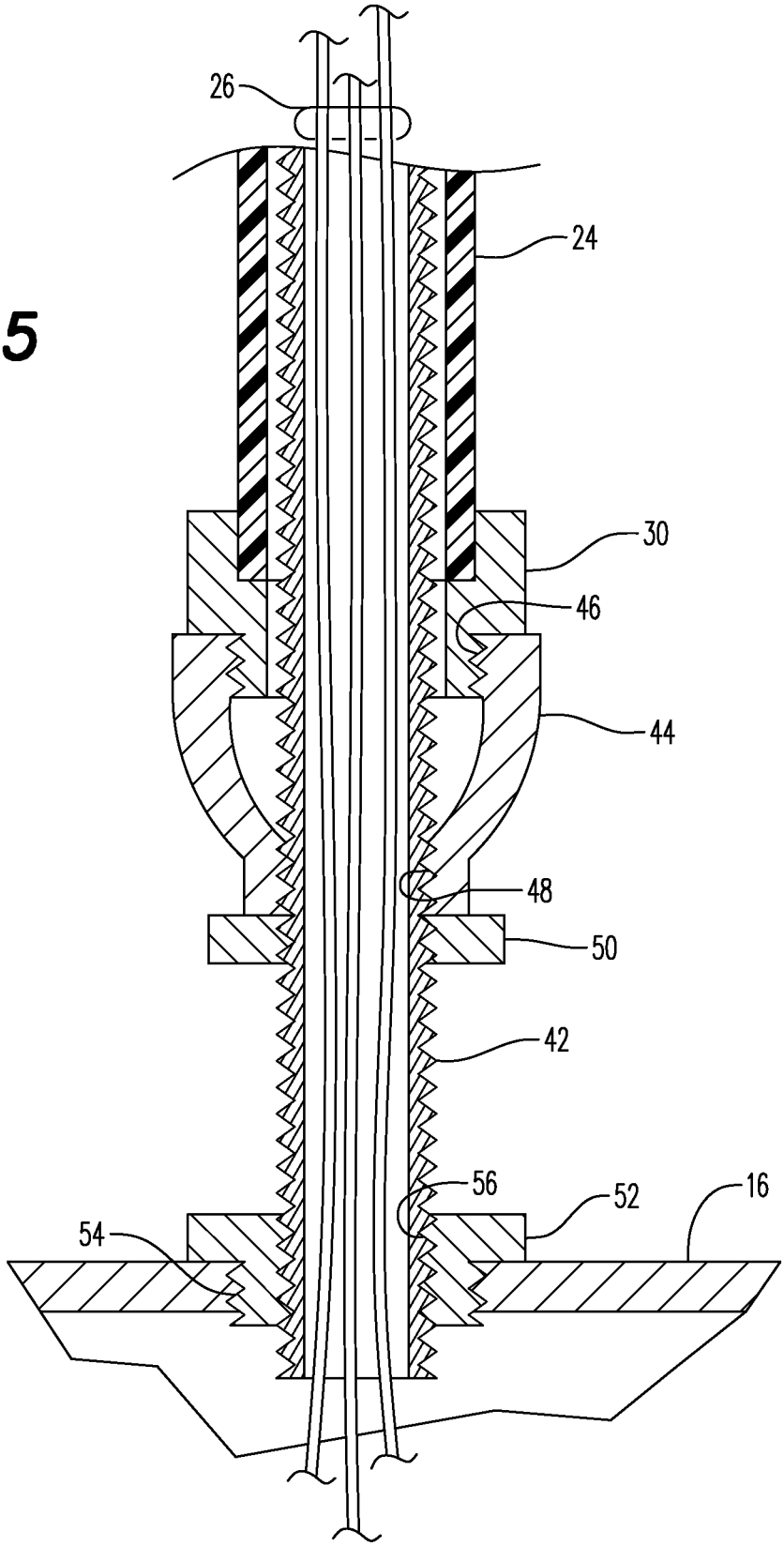
FIG. 5 is an enlarged section view of the lower portion of FIG. 4.
Figure 6:
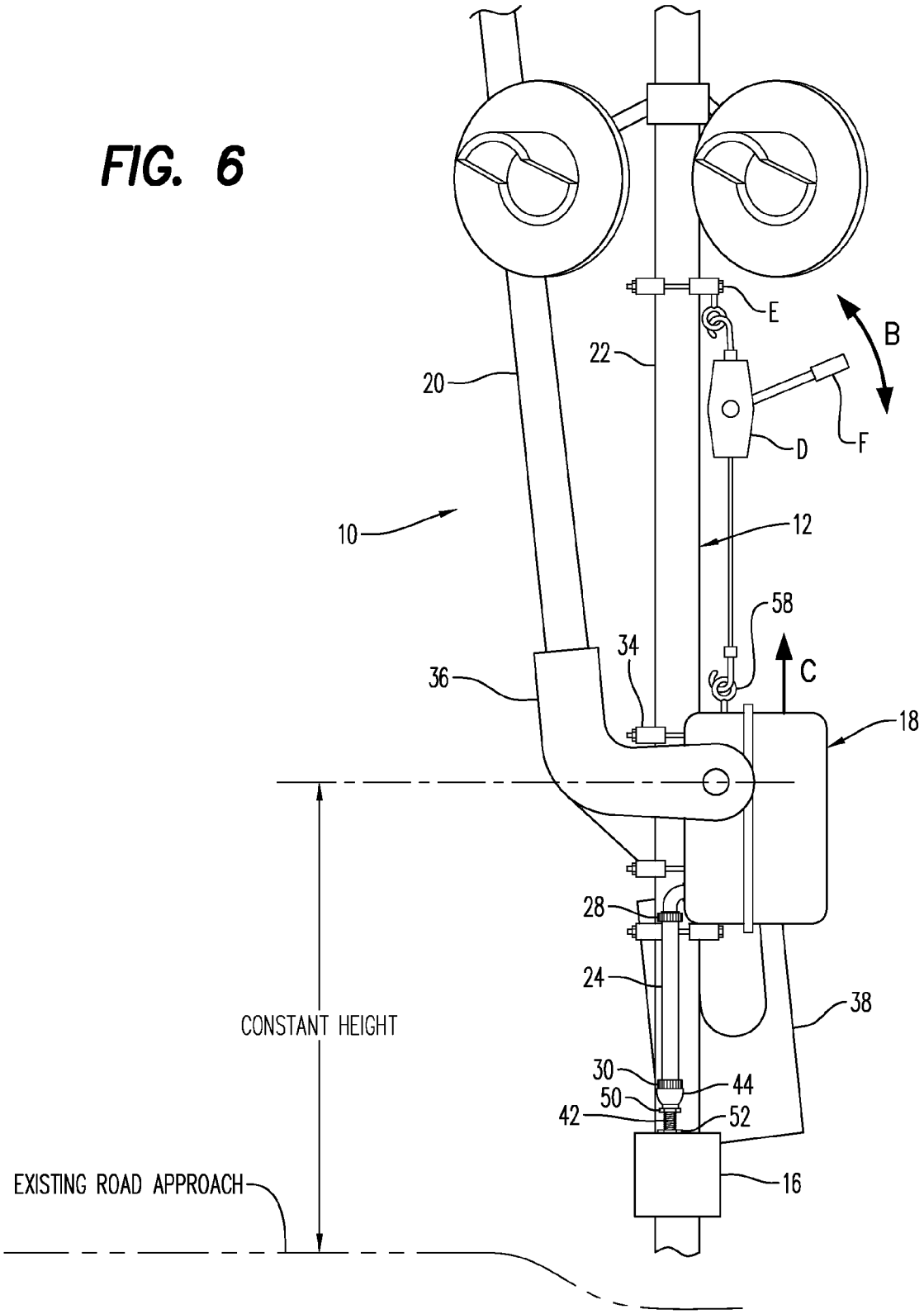
FIG. 6 is a perspective view of the railroad crossing gate apparatus showing the invention after installation therein and after the road approach has been elevated by repair.

Referring additionally to FIGS. 4 to 6, after the road approach has been repaired and increased in height by the addition of road repair material such as asphalt, concrete or the like, the height of the crossing gate which must be maintained at a constant height above the road surface must be increased by the raising of the gate mechanism 18 along the length of the upright signal mast 22. To facilitate this raising of the gate mechanism 18 and the pivotally supported crossing gate 20 so as to reestablish the required constant height of the gate crossing gate 20 when in a down position, a come-along or winch D is fastened at an upper end thereof to an eye bracket E clamped onto the signal mast 22 at a height above the gate mechanism 18. A lower end of the come-along D is attached to an eye-bolt 58 which has been secured into the upper surface of the gate mechanism 18. By operation of the come-along through movement of its lever F in the direction of arrow B, the gate mechanism 18 is lifted in the direction of arrow C.

Prior to the above upward readjustment or upward repositioning of the gate mechanism 18, the lower coupling 30 attached at the lower end of the existing wiring conduit 24 is unthreaded from the threaded aperture formed in the top surface of the gate base 16 and the wiring is disconnected from within the gate base and removed from the wiring conduit 24. As the wiring conduit 24 is somewhat flexible, it may be deflected laterally so that the invention 40, and particularly the threaded pipe 42 may then be inserted into and through the lower coupling 30, after which the upper internally threaded end of the reducer 44 is threadably engaged onto and locked with the external threads of the lower coupling 30. The lower end of the threaded pipe 42 is then threadably engaged into bushing 52 after the bushing has been threadably secured into the threaded aperture in the top of the gate base 16. Then, by simply rotating the bushing 44 in either direction on the threaded pipe 42, a proper new height for the telescoping conduit, in keeping with the previously described upward height adjustment of the gate mechanism 18 is thus established. Retightening of the previously loosened support brackets 34 secures the new positioning of the gate mechanism 18, after which the come-along D is removed.

Figure 7:
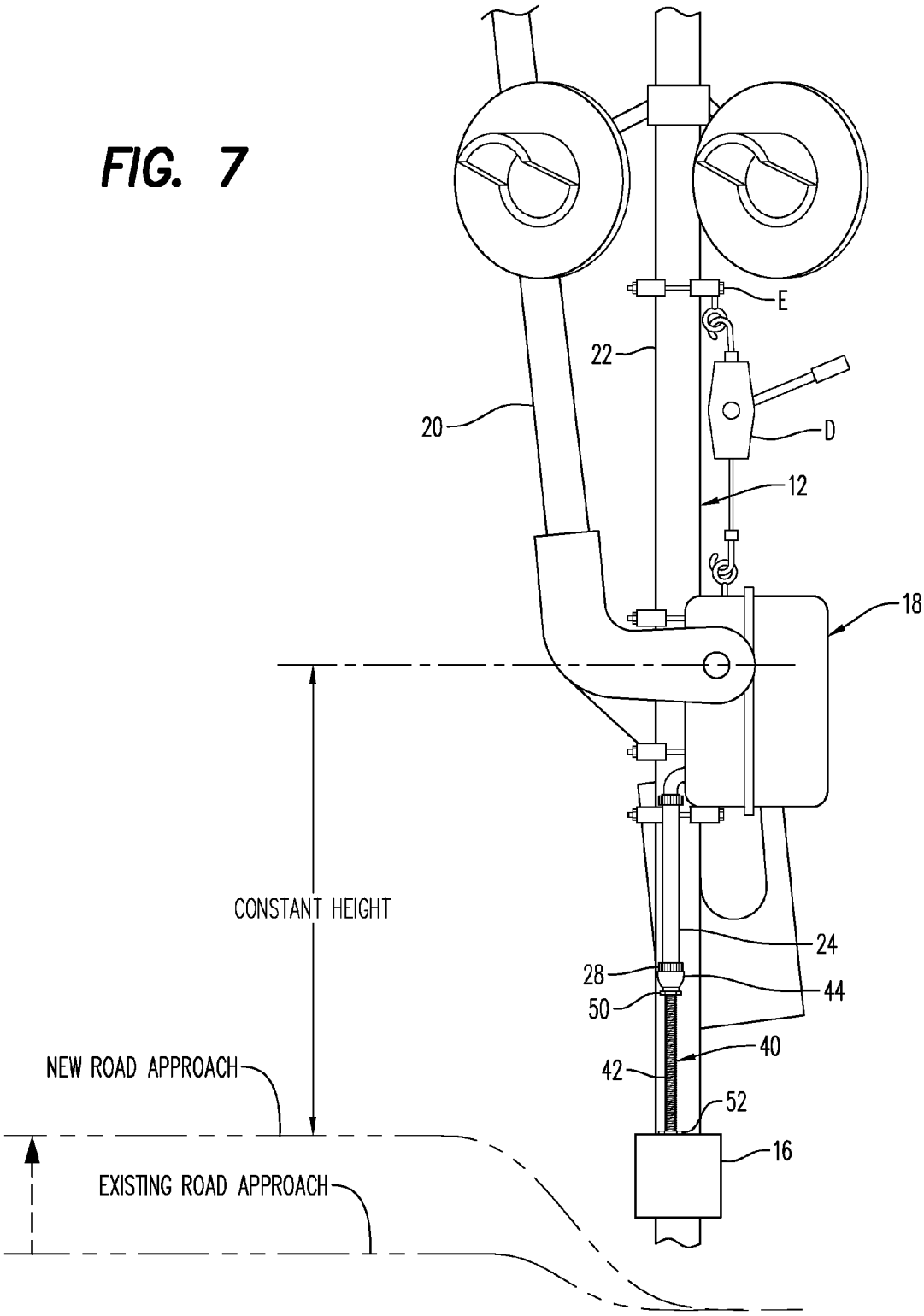
FIG. 7 is a view similar to FIG. 6 showing a subsequent height reestablishment after a further road approach elevated by repair has been implemented.
Figure 8:
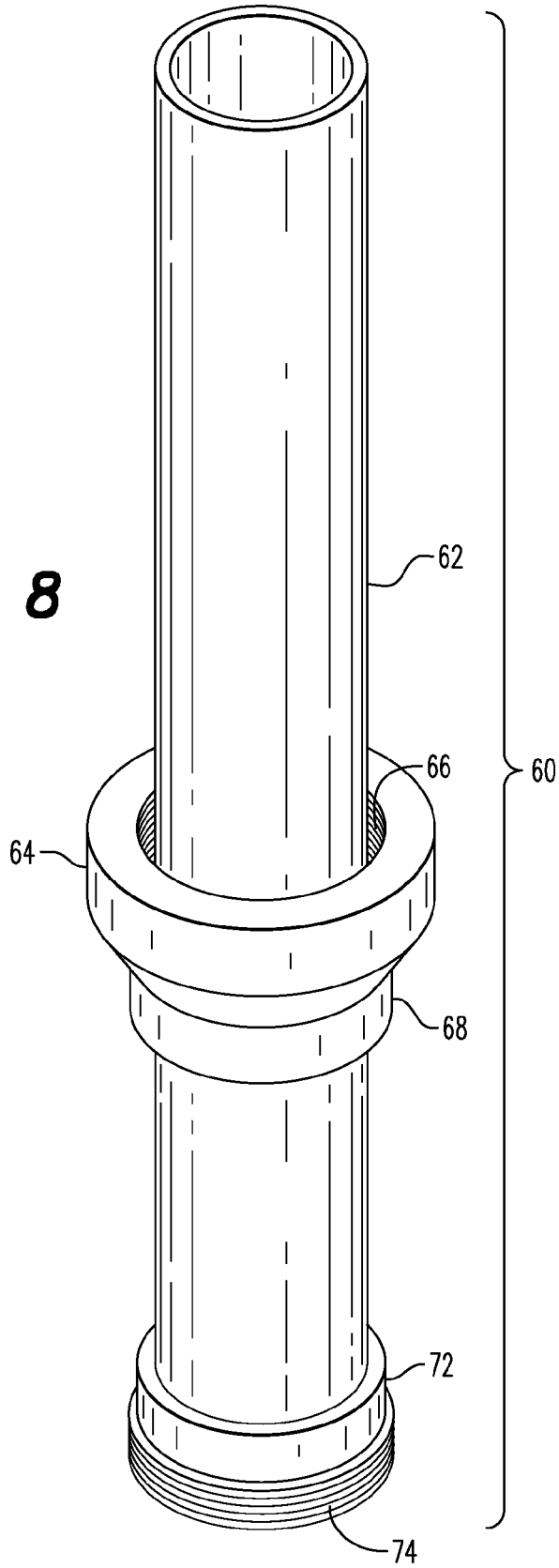
FIG. 8 is a perspective view of the preferred embodiment of the invention.

Referring now to FIG. 7, a subsequent road approach repair causing an additional height elevation of the road approach surface is there shown. The procedure for increasing the height of the crossing gate 20 and the supporting gate mechanism 18 is as previously described. However, no rewiring is required, nor must the wiring conduit 24 be disconnected in any way. The height adjustment is simply effected as the gate mechanism 18 is elevated by come-along D as previously described by the simple rotation of the reducer 44 after the jam nut 50 has been loosened. This exposes an additional length of the threaded pipe 42 as required to maintain the constant height of the crossing gate above the new road approach surface.

Referring now to FIGS. 8 to 11, the preferred embodiment of the invention is there shown generally at numeral 60 and includes an elongated smooth pipe 62 having an cylindrical external surface over which a sliding coupling 64 is slidably engaged along the length of the smooth pipe 62. The sliding coupling 64 includes an internal thread 66 formed into the upper end thereof which threadably engages onto the external thread 59 of the lower coupling as previously described. The lower end 68 of the sliding coupling 64 has a smooth internal surface forming mating sliding surfaces at 70 between the exterior surface of the smooth pipe 62 and the internal surface of the sliding collar 68.

Figure 9:
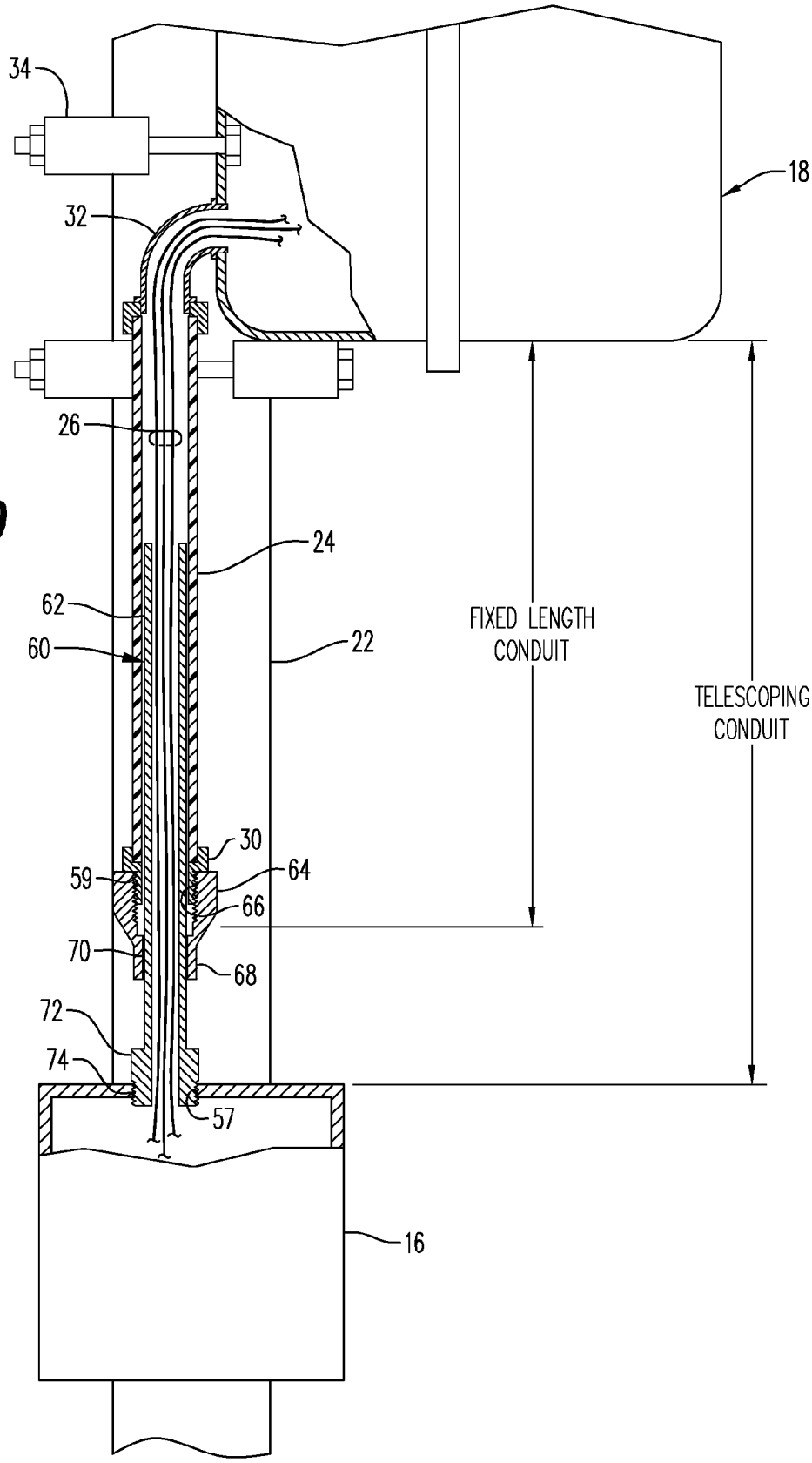
FIG. 9 is a view similar to FIG. 2 after the invention of FIG. 8 has been installed during height reestablishment of the gate mechanism 18 and the crossing gate attached thereto.
Figure 10:
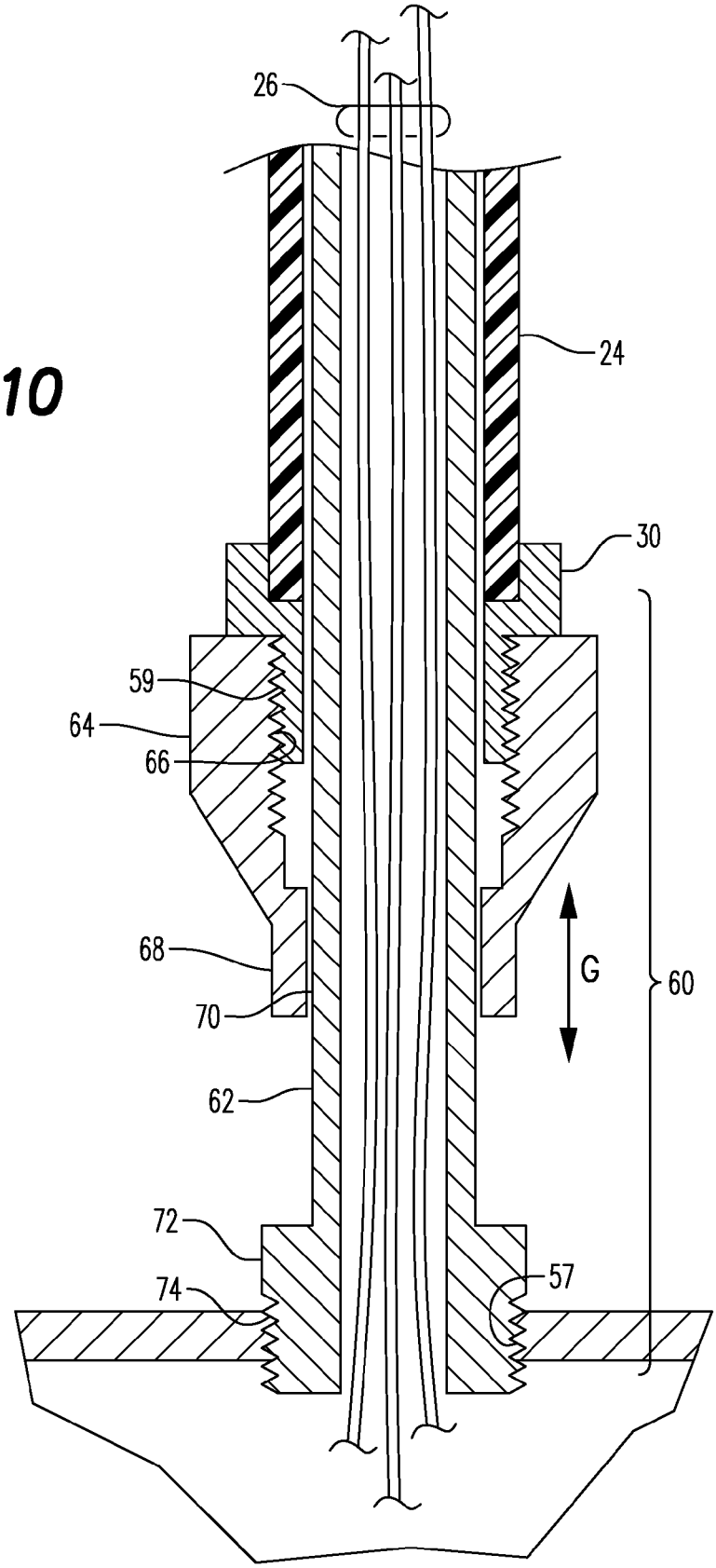
FIG. 10 is an enlarged section view of the lower portion of FIG. 9.

The lower end 72 of the smooth pipe 62 includes an external thread 74 which, as best seen in FIGS. 9 and 10, is threadably engageable into the internal thread 57 formed into the top surface of gate base 16 to support the smooth pipe 62 securely in an upright orientation.

Figure 11:
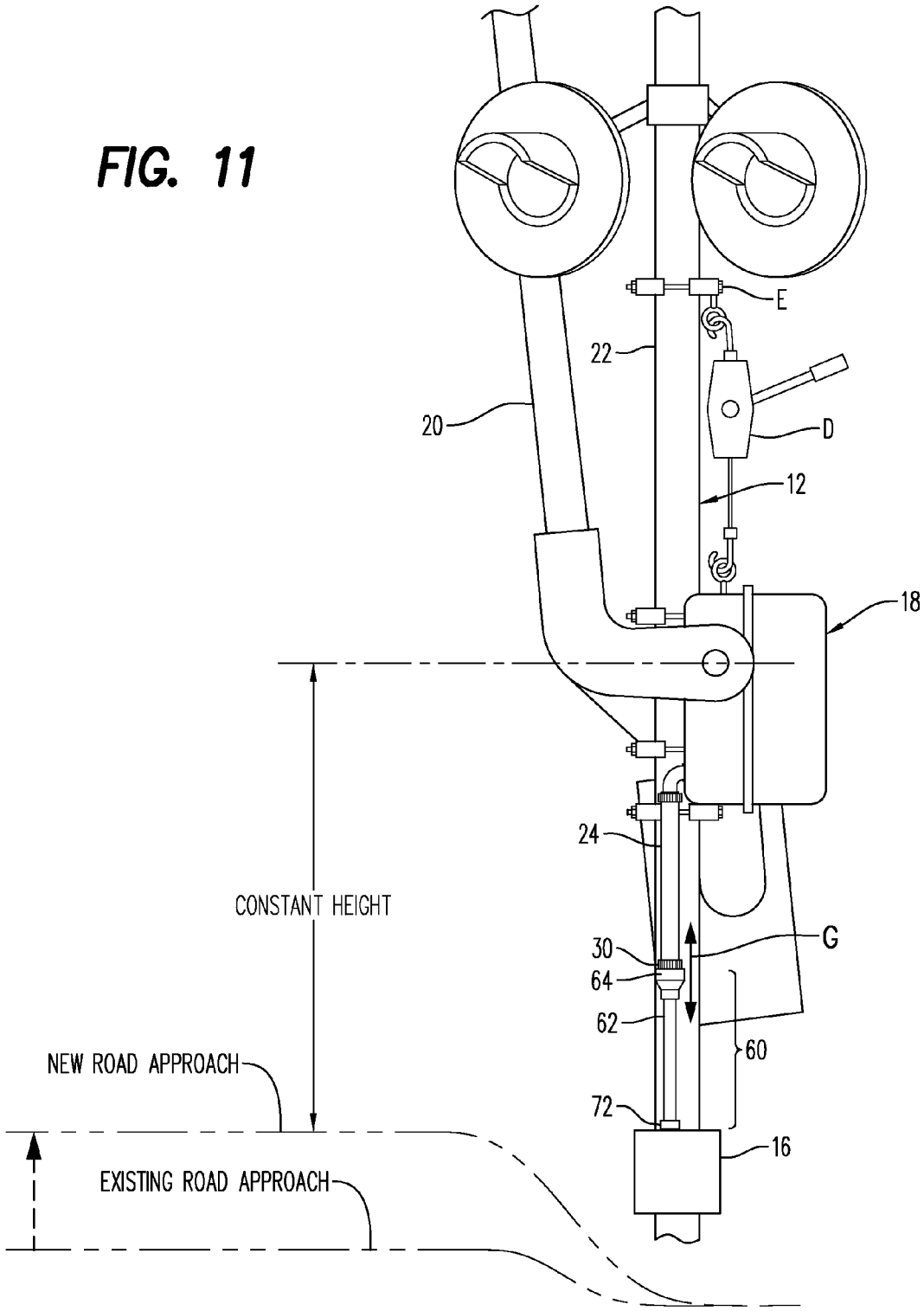
FIG. 11 is a view similar to FIG. 7 showing the subsequent height reestablishment after a further road approach elevated by repair has been implemented utilizing the embodiment of FIG. 8.

Installation of this embodiment 60 is substantially identical to that previously described with respect to the assembly 40 with the exception that the sliding coupling no longer needs to be threadably engaged along the length of the smooth pipe 62, but rather is slid in the direction of arrow G in FIGS. 10 and 11 along the length thereof as required to accommodate the increased elevation of the gate mechanism 18, again as previously described. Once the sliding coupling 64 has been slid upwardly it is threadably engaged onto the external thread 59 of the lower coupling 30 to secure the reestablished height and protectively house the internal wiring 26 as previously described.

By providing this embodiment 60, therefore, the number of components required and the complexity of manufacture has been reduced down to two simple components, the smooth pipe 62 having a lower external thread 74 in combination with the sliding coupling 64 which now slidably engages over the smooth exterior surface of the smooth pipe 62. It has been determined that the threadable engagement between the reducer 44 and the elongated threaded pipe 42 is no longer required to adequately reestablish the protective encasement of the wiring 26 associated with the increased elevation required for the gate mechanism 18. Adequate stability for this installation is established therefore between the mating thread engagements between the internal thread 57 and the external thread 74 at the lower end of the smooth pipe 62 at the mid or upper portion of the smooth pipe 62. The threadable engagement between the internal threads 66 of the sliding coupling 64 and the external threads 59 of the lower coupling 30 adequately secure this arrangement.

While a number of exemplary aspects and embodiments have been discussed above, those of skill in the art will recognize certain modifications, permutations and additions and subcombinations thereof. It is therefore intended that the following appended claims and claims hereinafter introduced are interpreted to include all such modifications, permutations, additions and subcombinations that are within their true spirit and scope.

The invention claimed is:

1. A railroad crossing gate height adjustment assembly for establishing or reestablishing a height of the crossing gate of a railroad crossing gate apparatus comprising:

an elongated smooth pipe;

a sliding coupling slidably engageable at a lower end thereof onto, and adjustably positionable along a length of, said smooth pipe, a larger, upper end of said sliding coupling threadably engageable with an externally threaded coupling secured at a lower end of a wiring conduit of the gate apparatus whereby the length of the wiring conduit is adjustably increased by said smooth pipe;

a lower end of said smooth pipe having an external thread engageable into a threaded hole in a top surface of a gate base of the railroad crossing gate apparatus for supporting said smooth pipe.

2. A railroad crossing gate height adjustment assembly for establishing or reestablishing a height of a crossing gate of a railroad crossing gate apparatus, the gate apparatus including an upright signal mast secured in the ground, a gate base connected to a lower portion of the signal mast, a gate mechanism connected to the signal mast above the gate base, the gate mechanism operably supporting the crossing gate, and an elongated wiring conduit of fixed length connected at each end thereof, and extending between, the gate base and the gate mechanism, said assembly comprising:

an elongated smooth pipe;

a sliding coupling slidably engageable at a lower end thereof onto, and adjustably positionable along a length of, said smooth pipe, a larger, upper end of said sliding coupling threadably engageable with an externally threaded coupling secured at a lower end of the wiring conduit whereby the length of the wiring conduit is adjustably increased by said smooth pipe;

a lower end of said smooth pipe having an external thread engageable onto a threaded hole in a top surface of a gate base of the railroad crossing gate apparatus for supporting said smooth pipe.

3. A method of establishing or reestablishing a height of a crossing gate of a railroad crossing gate apparatus, the gate apparatus including an upright signal mast secured in the ground, a gate base connected to a lower portion of the signal mast, a gate mechanism connected to the signal mast above the gate base, the gate mechanism operably supporting the crossing gate, and an elongated wiring conduit of fixed length connected at each end thereof by an upper and a lower coupling and extending between the gate base and the gate mechanism, said method comprising:

a. disconnecting the lower coupling and wiring conduit connected thereto from the gate base;

b. establishing or reestablishing a new height of the gate mechanism and wiring conduit to raise the height of the crossing gate to a specified distance above a new road approach to a train track;

c. inserting one end of an elongated smooth pipe into and through the lower coupling;

d. slidably engaging a lower end of a sliding coupling onto, and adjustably positioned along a length of, said smooth pipe;

e. threadably engaging larger, upper end of an internal thread of said sliding coupling with the second coupling secured at a lower end of the wiring conduit whereby the length of the wiring conduit is adjustably increased by an exposed length of said smooth pipe;

f. threadably engaging an external thread of a lower end of said smooth pipe into a threaded hole in a top surface of a gate base of the railroad crossing gate apparatus after removal of the second coupling for supporting said threaded pipe.

* * * * *